United States Patent [19]

Brovman

[11] Patent Number: 4,655,135

[45] Date of Patent: Apr. 7, 1987

[54] ADAPTIVE CONTROL SYSTEM FOR PRESS PRESETTING

[75] Inventor: Yakov Z. Brovman, Mystic, Conn.

[73] Assignee: Harris Graphics Corporation, Westerly, R.I.

[21] Appl. No.: 311,826

[22] Filed: Oct. 16, 1981

[51] Int. Cl.[4] ..... B41F 31/04; B41F 33/16

[52] U.S. Cl. ..... 101/426; 101/365

[58] Field of Search ..... 101/365, 426, 350, 349; 250/559, 571; 356/444, 443

[56] References Cited

U.S. PATENT DOCUMENTS 3,930,447 1/1976 Murray et al. ..... 101/365

3,958,509 5/1976 Murray et al. ..... 101/426

OTHER PUBLICATIONS

Densi Control System Remote Ink Module, operators manual, Harris Corp., publication 447498-0, Oct., 1981.

IEEE 1982 Iecon Proceedings, Nov. 15-19, 1982.

*Primary Examiner*—J. Reed Fisher

*Attorney, Agent, or Firm*—Biebel, French & Nauman

[57] ABSTRACT

A process for the continuous and automatic presetting of the fountain keys (48) a printing press (10) based on objective data obtained from scanning an image to be printed by means of a light table (70) identifies that family of printing jobs wherein an objective relationship has been established between the objectively obtained ink coverage data obtained from the light table and the key settings actually established for each of those jobs by a pressman. A minimum of four jobs are selected for adaptation, and in the preferred embodiment, as many as ten jobs are included within the group selected for adaptation. If four or more jobs in a row are rejected as being outside the selected family of jobs, then a separate adaptation procedure is used to determine whether these jobs establish an objective relationship, and if so, then they will be used to derive the information necessary for presetting the press. In the preferred embodiment, a Fourier analysis is used to determine the relationship between the objective data derived from the light table and the pressman's key settings for each particular job.

4 Claims, 12 Drawing Figures

ADAPTIVE CONTROL SYSTEM FOR PRESS PRESETTING

BACKGROUND OF THE INVENTION

This invention relates to a method for presetting a machine, such as a printing press, which produces multiple copies of a product which are judged as to acceptability at least in part by subjective operator evaluation.

This invention has application to any machine or process wherein an objective standard may be used initially in presetting the machine, and wherein the machine output can thereafter be varied or adjusted in accordance with a subjective determination by its operator.

A typical example is in the setting of each of the ink fountains on a printing press. Each fountain is provided with a plurality of keys, all of which are adjusted prior to printing, to meter the amount of ink flowing onto the printing plate. In manually operated presses, the pressman will first scan visually the printing plate and estimate the amount of ink needed within each of the sections controlled by the keys of the ink fountain. There are other systems wherein an optical scanner is used to scan a printing plate to determine the amount of ink needed within certain narrow sections of the printing plate, and that information is then processed to set automatically the corresponding keys of each fountain.

Many modern day presses are provided with electromechanical means for setting the keys from a remote location, and also transducers for indicating each key position at a remote location, for example, on a television screen. Also, means may be provided to record the information from the optical scanner regarding the percentage of coverage on the printing plate for each key position. Key position and other press information deemed by the pressman to represent the best printing quality is recorded so that, if the printing run were interrupted, for whatever reason, that information could then be recalled and used to preset the machine when printing is resumed using those same plates.

Previously, the keys of the fountain were preset either according to the judgment of the pressman or by automatic means as described above. Once these initial adjustments were made, the press was then started and further adjustments made to the fountains and other systems, such as to compensate for registration of various colors, water fountains, etc., to improve the quality of the output until it achieved acceptable quality, known as "save" quality. As the press continued to run, still further fine adjustments were made by the pressman until, usually after several hours of running, a quality of printing of high grade results, known as "OK" quality. It is the "OK" quality settings that are recorded for later use should the printing operation be interrupted, for example by a priority printing job, during the middle of a run.

Information from a plurality of previously completed jobs, including data obtained from an objective source and data obtained from a subjective source, are analyzed and compared to provide parameters which thereafter are used in setting machine functions in response to subsequently obtained objective data.

Specifically, the objective data, such as the amount of coverage as determined by the optical scanner, for each of the elements to be controlled, such as keys, is analyzed mathematically, and a Fourier analysis is made to derive amplitude information for a plurality of harmonics sufficient to represent accurately the relationship between the objective data and the element to be controlled.

Similarly, the subjective data, such as setting as determined by the pressman for the "OK" condition, for each of the machine elements to be controlled, such as keys, is also analyzed mathematically and represented by a plurality of amplitude values for a sufficient number of harmonics to represent accurately the above mentioned relationship.

In presetting the ink fountains of printing presses, it has been found that an analysis of only the first four harmonics of the above information will provide accurate information, as disclosed in copending application Ser. No. 51,930, filed June 25, 1979. Preferably, the average or zero harmonic is taken, and the sine and cosine functions of the first, second, third and fourth harmonics analyzed.

For each of the above nine analysis, derived from a Fourier analysis of each of the waveforms for the objective data and the subjective data, i.e., the percent coverage versus key number and key setting versus key number representations, an amplitude value is obtained. Therefore, for each of the nine analysis, for each job, there will be a single point representing the relationship between objective data (percent coverage) and subjective data (key setting). The data points for all jobs for each of the nine analysis are then plotted, and both the slope and the offset of these relationships are found by the least squares method. This information is then used to predict the key settings likely to be made by an operator on a particular press when a new set of objectively derived data is obtained.

When the method described above was first proposed, it had been assumed that the parameter identifier would be more or less traditional, based on statistical evaluation of adaptive parameters for at least 10 recent jobs, and that updating of parameters would be made not very often, at least every several months. But experience made it clear that the control strategy should be much more complex.

First of all, many jobs, with so-called "bad plates" or "dead alleys," didn't fit any adaptation at all and had to be ignored when they appeared. On the other hand, blown-up ink rolls or unscheduled maintenances appeared quite often; they changed inker's parameters drastically; and therefore they required ignoring the previous information and starting the adaptation anew.

From our human experience, it seems to be simple to ignore something (or someone), but this is not true with automatic systems: they are objective, and therefore they need a reason for ignoring; so both a concept, and a method, and criteria for acceptance/rejection must be developed. These items appeared to be not trivial. Not only was a decision-making procedure in the adaptive controls not available in the prior art, but the existing philosophy of adaptive control could not be applied.

For example, if one tried to apply the well-established notion of running averages (or cumulative sums, or stochastic approximation), failure would result. In a process of adaptation, the established majority (a "mafia-like family") will test every newcoming job for fitness, and the "family" will reject those newcomers on a one-by-one basis even if the newcomers as a group present a new majority, i.e., even if they present an objective change in press condition that should be adapted. Hence, using the traditional statistical adaptation procedure for the acceptance test purposes makes the adaptation itself impossible.

Other pitfalls that had to be avoided are: (1) "Adaptation by default" due to not assured redundancy (two-job adaptation), or not assured alternative adaptation for rejected jobs, etc.; (2) r.m.s. adaptation error as a criterion; and (3) saving jobs for adaptation on a job, not a fountain-basis.

SUMMARY OF THE INVENTION

In the present invention, an on-line adaptive feedback system (auto-adaptation routine) has both a unique concept, and a unique method of parameter identification.

The concept of identification is based on a notion of a "family" of jobs which fit each other in a sense that each of the jobs in the family, preset with parameters found, shall have small errors. Therefore, the objective of identification is twofold: not only evaluate the inker's parameters from a set of jobs available for adaptation, but also isolate such a subset of jobs which will make the found parameters valid.

This approach is necessary because of peculiar, subjective nature of information available for adaptation. Many inconsistent pressmen's key settings are not only due to some objective causes, such as bad plates or dead alleys, but mostly due to some low-quality jobs, without halftones or contrasts, when the pressmen simply does not care. The fast growing market of multi-color advertisement inserts is an example of such cases.

Thus, separating a group of jobs which represent an objective relationship between the ink coverages and the key settings for each given inker is a prerequisite of a proper parameter identification.

The multitude of different parameter identification methods developed hitherto are, by contrast, purely statistical. They all are based on large enough samples so that statistical stability can be reached, and if the accuracy of identification is not satisfactory, the only way to improve it is to increase the size of a sample. Most of the methods have been verified theoretically with the notorious "extent to infinity" of sample size ($n \rightarrow \infty$). This is true both for performance-adaptive, and for parameter-adaptive controls, for different approaches based on stochastic approximation, and both for explicit, and for implicit models. Moreover, eliminating "bad," with large errors, cases from a sample in order to get a "nice statistic" has been considered as a most common sin, even crime of unscrupulous statisticians. But, this is exactly what is being done in this invention.

The adaptation system of this invention is based on presumption that the inker is a deterministic, not stochastic system, a system with reducible uncertainty. Therefore, if the adapted jobs are consistent, a regression line A (FIG. 10*a*) drawn through them will present the inker's objective parameters, its transfer function (m) and setpoint (b), and the jobs 1–5 will have small errors (e). What distorts the adaptation is a number of inconsistent jobs, (points 6, 7 in FIG. 10*b*), bringing about a completely wrong regression line B which represents nothing.

In order to identify the inker parameters properly, a set of rules or algorithms must be established for eliminating the inconsistent jobs.

The Number of jobs N selected for adaptation is between an upper limit of (N)=10 and a lower limit of (N)=4.

By way of explanation, to draw a straight line, at least 2 points/jobs are needed. But, one can draw a perfect line, with zero errors e, through any 2 points, including the inconsistent jobs (FIG. 10*c*). Therefore, to avoid such an "adaptation by default," some redundancy is needed. Three jobs are not enough, because with two jobs (1 and 2 in FIG. 10*d*) close to each other, both a correct (line D) and an incorrect (line $D^1$) adaptation will show the same small acceptable errors. Thus, four jobs are both necessary and sufficient for the lower limit of jobs.

Abrupt changes in press condition are such a serious matter that a special procedure should be developed to handle them. First of all, the proper adaptation should be restored as soon as possible in this case. This is why the lower limit of four jobs is so important. Secondly, the inconsistent jobs may appear in numbers of up to 6 to 8 in a row (jobs with "dead alleys," low-quality or simply black-and-white jobs can follow each other). During this period, the press can change its parameters, and the new consistent jobs will be rejected by the "mafia-like" old family.

To handle both those cases, an alternative adaptation procedure has been developed. If four or more jobs have been rejected in a row, the system routinely tries to adapt to them—separately from the previously established family.

There are several situations which determine the strategy for selecting the jobs to be pooled for adaptation.

START-UP ADAPTATION. If no adaptation has been made before, all the latest available jobs—starting with 4 and up to 11—are pooled for adaptation.

CONTINUOUS ADAPTATION. If the first previously adapted job is no more than 10 jobs behind the current job, then all jobs, from the first to the current, both adapted and rejected before, are pooled for adaptation. The reason for the strategy seems to be obvious—with every new step in control, with a new job/information appearing, all partners, both previously accepted and rejected, should have "equal rights," a new opportunity, and it well may be that some previously adapted jobs will be dropped, and the previously rejected jobs will be adapted, because they fit the new press condition introduced by the current job.

FORGETTING THE OLD ADAPTATION. If more jobs have been recently rejected than previously adapted, and the first adapted job is more than fifteen jobs behind, only the rejected jobs should be pooled for adaptation. The decision to try the alternative adaptation right from the start is based on an assumption that the previous adaptation is too old and, therefore, invalid anyway.

TERMINAL ADAPTATION. If none of the considered above conditions is met, the system simply adds the current job to the pool established before, and starts adaptation anew. Under these conditions, the newcomer is not tested for fitness, but instead is accepted as an equal and has the "right to vote." Hence, there exists a chance that it can change the majority. Then, and more important, if the newcomer is rejected by the majority, the system will routinely try the alternative adaptation, thus completely ignoring the previously established majority.

After each cycle of adaptation, a special set of rules of the acceptance/rejection procedure must be applied to the pool.

ONE AT A TIME. If several jobs have unacceptable errors, only one job with the largest error should be eliminated; then after a new cycle of adaptation, the next job with the largest error will be dropped, and so on. FIG. 10*b* illustrates this case: if all jobs with large errors are dropped at once, not only the inconsistent jobs #6 and #7 be eliminated, but also the good jobs #2, #5 and #1. The developed cycling procedure prevents it.

RANKING OF HARMONICS. As pointed out in copending application Ser. No. 51,930, the significance of harmonic components reduces with their number. The average (0 harmonic) is the most significant component, and the 5th and higher harmonics present only noise, if anything at all, and should be ignored at all. Thus, the acceptance testing should be on the harmonic basis. At first, check the errors for the first component and eliminate the job with the largest unacceptable harmonic error, thus initiating a new adaptation cycle without even adapting the next harmonics. Only if the errors of the first component are acceptable, adapt and check errors of the second component, and so on.

It is important that this necessary procedure also greatly simplifies the software and reduces the execution time.

RUNNING POOL. The system can take 10 jobs from the last adaptation and add to this full-size pool the current job thus making an 11-job adaptation. But, it will save only a 10-job pool by dropping the first adapted job. The "first-in-first-out" (FIFO) principle applied here assures proper updating of parameters for the extremely rich adaptation pools.

DEFAULT CONDITION. In order to preserve continuity and to prevent self-destruction of the adaptive feedback in unexpected situations (say, 20 rejected jobs in a row), every time when the system fails to re-adapt, it automatically retains the current adaptive parameters.

Criteria of satisfactory identification are based on a notion of "saveable preset accuracy."

CRITERION OF "SAVEABILITY" After starting saving signatures, it usually takes a pressman several hours to reach the best, "color OK" copies. Thus, there exists an objective, at least for a given printing house, "margin of saveability/acceptability" which may be presented quantitatively with an average and/or r.m.s. (root-mean-square) difference between the SAVE and OK key settings.

On the other hand, the goal of this invention is to allow to start saving copies right after the preset. In a word, a perfect system should have its preset errors within the "margin of saveability."

This margin for the two printing houses tested is:

| Differences | Press A | Press B |
|---|---|---|
| Average, mil | 1.27 | 0.45 |
| R.m.s., mil | 2.58 | 1.34 |

But the objective here is to present the acceptable preset accuracy for each harmonic component separately, not the overall. Fortunately, it can be done.

R.M.S. ERROR AND PARSEVAL'S RESULT. Parseval's result (Bajpai, A. C., Mustoe, L. R., Walker, Walker, D., "Advanced Engineering Mathematics," John Wiley & Sons, N.Y., 1977) deals exactly with the relationship between the process r.m.s. value $\epsilon$ and its Fourier harmonics $R_k$:

$$\epsilon^2 = R_0^2 + \tfrac{1}{2}\sum_{\kappa=1}^{\infty} R_\kappa^2$$

where $R_o$ is the average, the 0 harmonic. Presenting this result in the effective, not amplitude values of harmonics $R_k^1$ $$R_k^1 = R_k/\sqrt{2}\ ,$$

we can simplify the result:

$$\epsilon^2 = \sum_{k=0}^{\infty} R_k^{1\,2}$$

Assuming that the r.m.s. error is equally distributed between all the 9 harmonic components, we can find the allowable error for each component:

$$|R_k^1| \leqq \sqrt{\epsilon^2/9} = \epsilon/3$$

It can be seen that the error for the 0 harmonic is exactly $\frac{1}{3}$ of the r.m.s. error for Press B, and it is $\frac{1}{2}$ for Press A.

CRITERION OF A "NEGLIGIBLE ERROR." The same "rule of $\frac{1}{3}$" can be established from a different viewpoint.

Assume that, having many harmonic components, we want to establish such a condition that occurrence of a new allowable harmonic error practically does not change the overall r.m.s. error. In other words, appearance of $|R_k^1|$ will change $\epsilon$ no more than by 5%:

$$1.05\,\epsilon \geqq \sqrt{\epsilon^2 + R_k^{1\,2}}$$

Solution of (5) brings the same $\frac{1}{3}$:

$$|R_k^1 \leqq \epsilon/3.16$$

Thus, the "rule of $\frac{1}{3}$" is reliable for deriving the allowable harmonic error from the overall r.m.s. error.

DESIRED PERFORMANCE THRESHOLD. From the very beginning of algorithm development, it was implied that the expected preset error of a future job shall be equal to the average adaptation error of the previous jobs, or the same, that the future job belongs to the same family isolated from the previous jobs. Hence, the adaptation accuracy becomes an estimate of the system's preset accuracy, and the adaptation criterion is really the system's performance criterion.

Thus, by choosing the acceptable error of adaptation, we really choose the desirable system performance; the desired preset accuracy.

From the results of the two printing houses' performance analysis, we can derive the desired average r.m.s. error of "saveable" presets $\epsilon_a$:

$$\epsilon_a = \sqrt{(2.58^2 + 1.34^2)/2} = 2.06 \text{ mil},$$

and the threshold for acceptance/rejection of the harmonic components (amplitude values) $R_k$ will be:

$$|R_k| \leqq \sqrt{2}\ \epsilon_a/3 = 0.97 \text{ mil} \simeq 1.0 \text{ mil}$$

For the average error (0 harmonic) $R_o$ the desired threshold could be a little less:

$$|R_o| \leqq (1.27+0.45)/2 = 0.86 \text{ mil},$$

but simply for uniformity reasons, we will assume the same 1-mil threshold:

$$|R_o| \leqq 1.0 \text{ mil}$$

It is therefore an object of this invention to provide a process for presetting the fountains of a printing press based on objective data obtained from optically scanning the material to be printed, comprising the steps of: optically scanning the material to be printed along those areas corresponding to the keys of an ink fountain to obtain objective data regarding the average density of ink coverage in those areas; storing said objective data derived from a predetermined number of the most recent jobs run on a particular printing press; sensing the position of each key of an ink fountain after the keys have been set to the operator's satisfaction as subjective data representing a particular job; storing said subjective data for a corresponding number of the most recent jobs; correlating the objective and the subjective data for each of the jobs accumulated; calculating a regression line representing the best fit among all of the stored jobs; comparing each job to the calculated regression line, and rejecting that job which has the greatest deviation from said regression line in excess of a predetermined acceptable limit; recalculating a new regression line to obtain the best fit among the remaining jobs; comparing each remaining job to the recalculated regression line and rejecting that job which has the greatest deviation in excess of a predetermined acceptable limit; repeating steps h and i until all jobs remaining fit the recalculated regression line within the acceptable limits; and using the redefined regression line to calculate the anticipated key settings for the next job to be run on the press based on the objective data obtained from optically scanning the material to be printed.

Other objects and advantages of the invention will be apparent from the following description, the accompanying drawings and the appended claims.

DESCRIPTION OF THE PREFERRED EMBODIMENT

Figure 1:
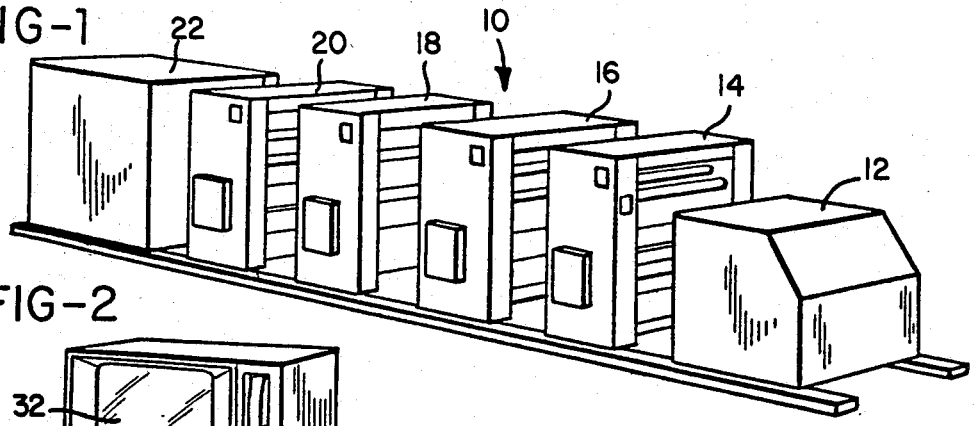
FIG. 1 is a perspective view illustrating a typical press in which this invention may be used.

Referring now to the drawings which illustrate a preferred embodiment of the invention, and particularly to FIG. 1, a typical press 10 includes a supply cabinet 12, press stations 14, 16, 18 and 20, and a dryer section 22. While a multiple section printing press is illustrated, it is to be understood that this invention is applicable to other types of machines wherein objectively obtained data may be processed and thereafter modified by the machine operator to produce a result which is pleasing to the eye. It is also understood that the press shown in FIG. 1 contains multiple sections, and that each of the sections can be independently controlled or modified in accordance with the invention hereinafter described.

Figure 2:
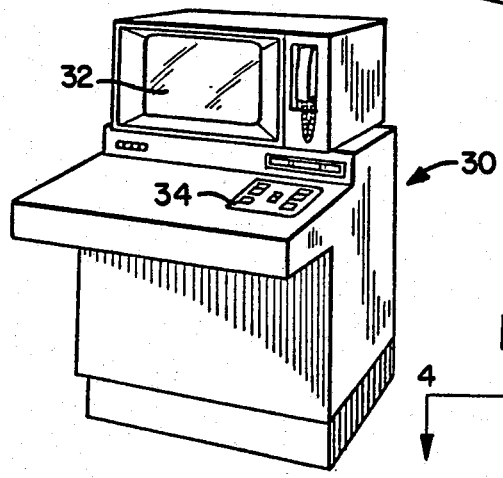
FIG. 2 represents a view of a control console for the press shown in FIG. 1.

FIG. 2 represents a control console 30 having a viewing screen 32 and a control panel 34. The position of the actuator keys on each of the fountain rolls of the press 10, for example, may be displayed visually on the screen 32, and those actuator positions varied according to the pressman's instructions by manipulation of the controls 34.

Figure 3:
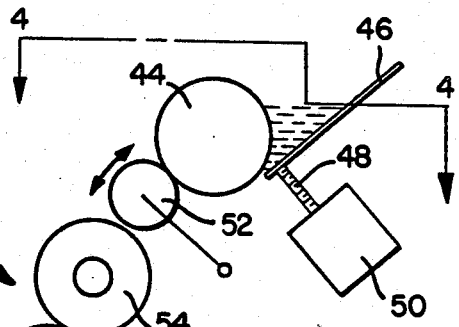
FIG. 3 illustrates a typical ink distribution system within the press.

FIG. 3 shows a typical ink distribution system 40 wherein ink is placed in a trough 42 formed between fountain roll 44 and the fountain blade 46. A plurality of keys 48 control the gap 48 between the blade 46 and the roll 44. The setting of the keys 48 is determined by actuators 50. In the example illustrated hereinafter, the press 10 has twelve fountains each including twenty-four keys.

A ductor roll 52 transfers the ink from the fountain roll 44 to an ink train including rolls 54–64 to the plate cylinder 64. Rolls 54, 56, 57, 59, 60 and 61 are distributor rolls; rolls 55, 58 and 62 are vibrator rolls; and rolls 63 and 64 are form rolls.

Figure 5:
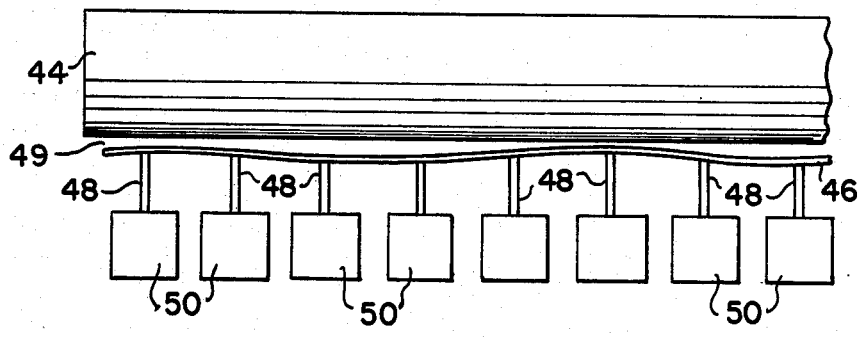
FIG. 5 is a view showing a portion of the fountain roll, the fountain blade, and the actuators which adjust the spacing between the blade and the fountain roll.

As illustrated in FIG. 5, the gap 49 between the blade 46 and the fountain roll 44 is determined by the setting of key 48. In FIG. 5, eight such keys are illustrated, with each key setting being determined by an actuator 50. The actuators may be controlled remotely from the console 30. Each actuator preferably includes a potentiometer or some other readout device so that the setting of the key 48 can be determined remotely, displayed on the screen 32 and recorded in a memory. The key setting information, and therefore the gap between the blade 46 and the roll 44 is also used for other purposes, as will be explained. During initial set up of the press, the keys 48 are adjusted to place the blade 46 adjacent the roll 44. In a typical press, a three mil spacing will permit sufficient ink to be transmitted to provide for a fifteen percent ink coverage.

Figure 6:
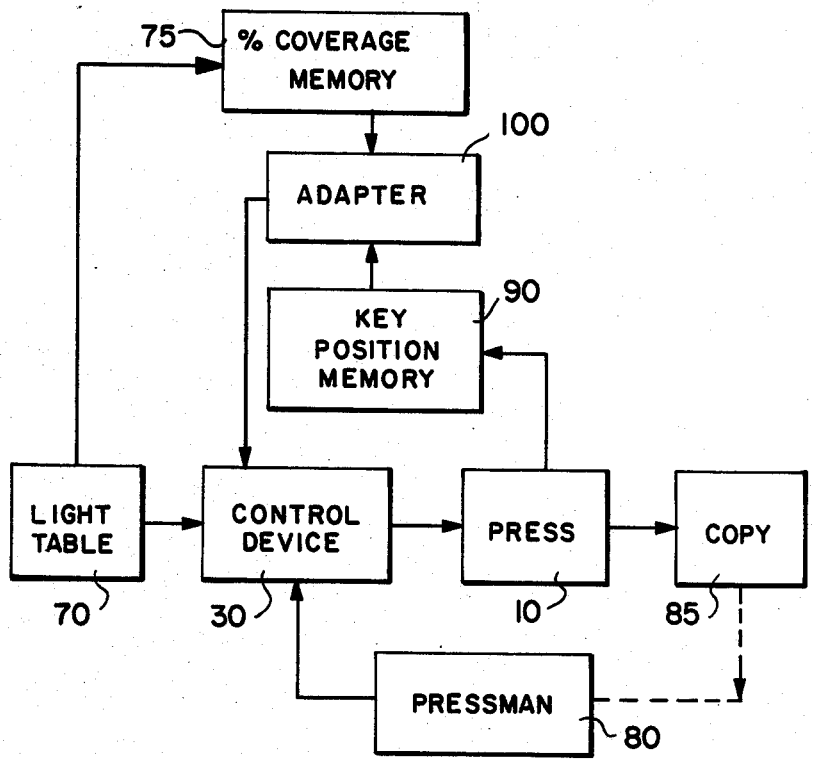
FIG. 6 is a simplified block diagram of a press illustrating the process normally followed in adjusting the press.

Turning now to FIG. 6, a light table 70 is a conventional device which is provided with a plurality of photosensitive elements for scanning the copy to be printed to determine the percentage of ink coverage in those areas corresponding to the areas controlled by the corresponding fountain keys. This data is an objective determination of the amount of ink needed for each key location across the plate cylinder and may be directed through the control console 30 to the press 10 and stored in a memory 75 and thereafter used in the manner hereinafter to be described.

It has been found through experience that a strictly linear correlation between the ink coverage values established by the light table 70 and the setting of the fountain keys 48 will not necessarily result in acceptable quality printing. This is due in part to the inability of the fountain blade 46 to depart radically from the spacing established by adjacent keys, the flexibility of the fountain blade itself, but mostly due to the action of the vibrator rolls 55, 58 and 62 in the ink train of FIG. 3. It has been discovered that adjustments to the keys 48 made by the pressman form a relatively smooth curve with respect to the fountain roll, and therefore a harmonic analysis of those settings is valuable in predicting future key settings.

An operator or pressman 80 visually observes the output of copy 85 from the machine or press 10 and judges the acceptability or quality of that output and then makes adjustments to the machine process, such as the setting of the fountain key, until the quality of the output is deemed satisfactory. In a multicolor press, for example, the amount as well as the distribution of the ink may be varied in small increments over a relatively long period of time before the highest quality output has been obtained Once the operator determines that further adjustments to the machine are unnecessary and that the highest quality output is being run, the adjustable machine settings are then recorded in a memory 90. That information will then be recalled and used to preset the machine at a later time should the printing run be interrupted for any reason.

Figure 7:
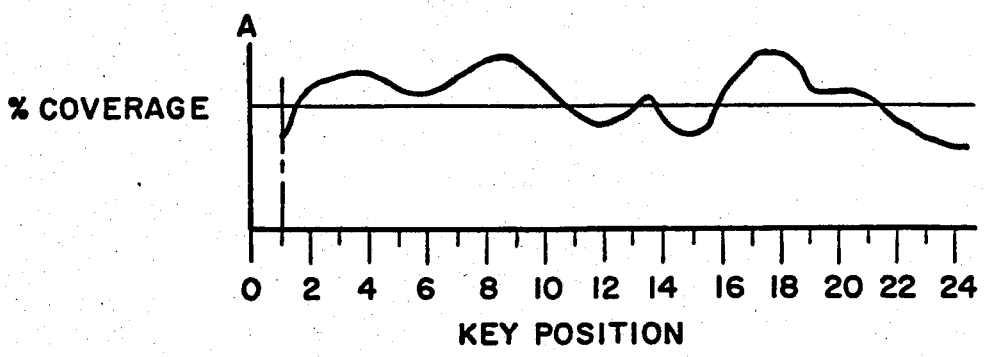
FIG. 7 is a chart showing the relationship between the average ink coverage on a given printing plate for each area controlled by a fountain key.

FIG. 7 shows the relationship between the fountain keys and the percentage of ink coverage for a particular printing operation. This represents objective data obtained by a properly calibrated optical instrument and is the information recorded in the memory 75 after the copy is scanned at the light table 70.

Figure 8:
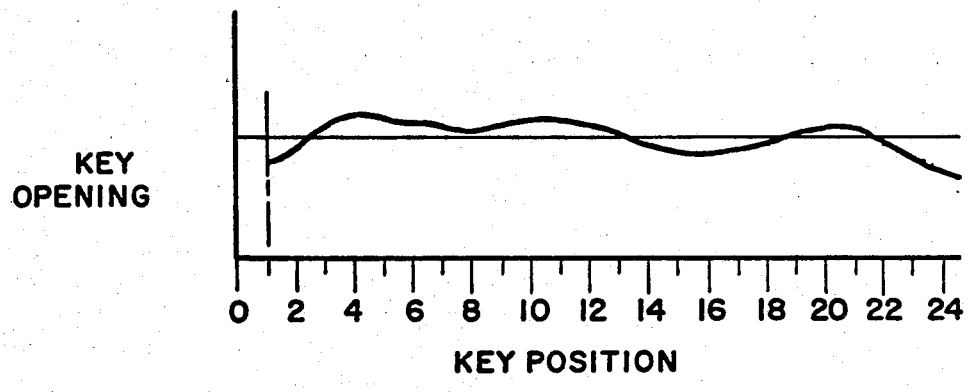
FIG. 8 is a chart showing the relationship between the setting of the fountain keys and the spacing between the blade and the fountain roll.

FIG. 8 shows the relationship between the fountain keys and the setting of those keys, or the gap between the fountain blade and the fountain roll. Typically, the resulting curve is smoothed because of the characteristics of the vibrator and the usual practice of the press operator. After the press has been run for some period of time, and several fine adjustments made to each fountain, and the operator is satisfied with the quality of the output, the setting of each key in each fountain is then recorded in the memory 90.

Both of the curves represented by FIGS. 7 and 8 are subjected to Fourier analysis. Since a typical press, and the one described herein, includes twenty-four key positions, twelve harmonic values may be analyzed; however, experience has shown that only the average and the first four harmonics need be analyzed to provide accurate key presetting instructions. A harmonic analysis has been found to approximate more closely the actions of the machine operator than a linear polynomial, or other type of analysis of the same information.

The first harmonic value appears to represent skewness, or the variations in spacing from one end of the rolls to the other within the ink train; the second harmonic appears to be a result of the pressman's personality, most of whom will close or substantially close the end keys; and other harmonics appear to be related to the state of the inker system—for example, irregularities in the rolls of the inking system of FIG. 3, such as humps and bumps.

The information stored in memories 75 and 90 for each of the fountains in a press (a typical press, and the one described hereinafter includes twelve fountains) for a plurality of printing jobs is correlated and the information obtained therefrom later used to preset the keys. By using the methods herein described for presetting the ink fountain keys, the quality of printing resulting from the press in ninety percent of the cases will be at least in the "save" category.

The number of jobs analyzed must be sufficiently large to provide a statistically accurate sample of the characteristics of the machine or press and represent the personality or characteristics and habits of the machine operator. It has been found that eight to ten press runs will provide sufficiently accurate information to preset the fountain keys as described.

Nine different harmonic analyses will be made for each of the curves of FIGS. 7 and 8 for each of the fountains of the press. The average is first obtained, and this may be designated the "zero" harmonics. Then the curves are analyzed for the first four harmonic values of both the sine and cosine functions. As a result, a single amplitude value is obtained from each of the harmonic analysis for both of the curves, and this data is then analyzed for each of the plurality of jobs investigated as illustrated in FIG. 9.

Figure 9:
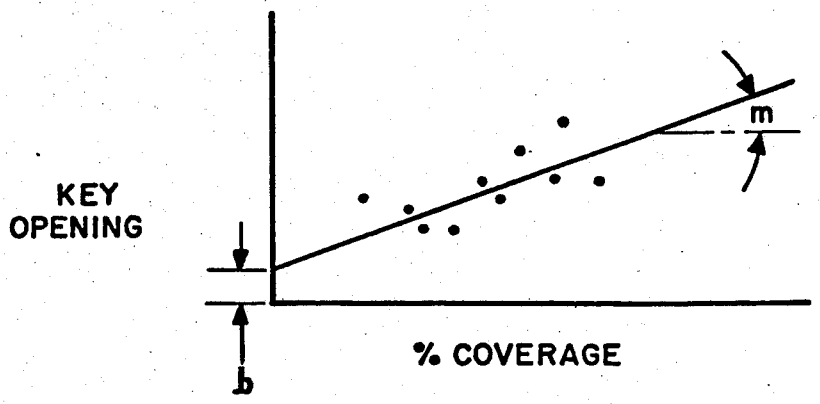
FIG. 9 is a diagram illustrating how the data obtained from a harmonic analysis of the charts of FIGS. 7 and 8 may be correlated for each harmonic component.
Figure 10:
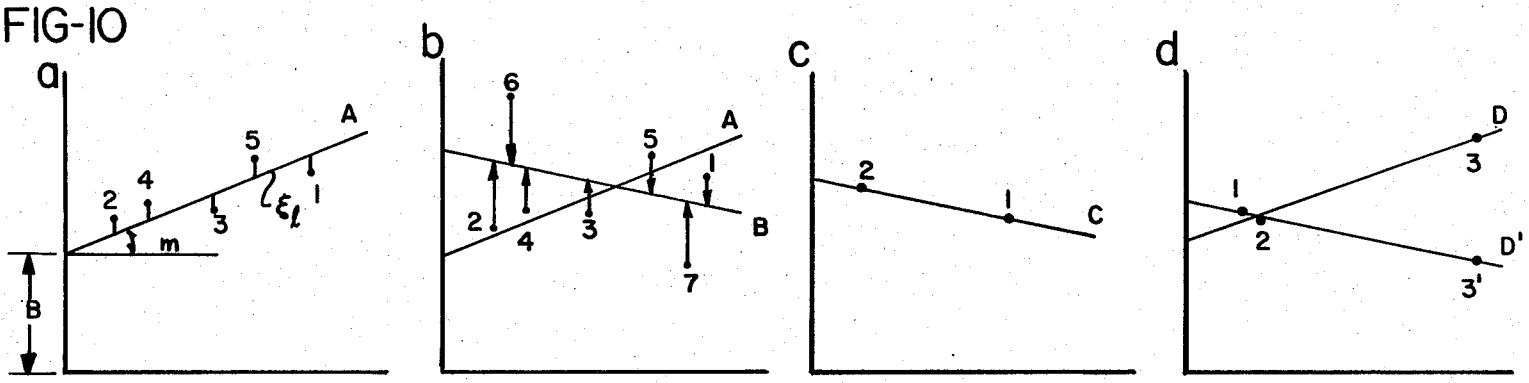
FIGS. 10*a–d* is a set of charts illustrating the selection of jobs to be included for consideration in the adaptive process.

For example, the average value of FIG. 7 is compared with the average of FIG. 8, and that is plotted in FIG. 9 as represented by a single dot thereon. The zero harmonic for each of ten jobs, for example, will be plotted on the same way, resulting in the plurality of dots shown in FIG. 9. A line is drawn through these dots as determined by the least squares fit procedure, and this line therefore represents the correlation between the average or zero harmonic analysis of FIG. 7.

Similarly, each of the remaining harmonic values for both the objective data of FIG. 7 and the subjective data of FIG. 8 are compared and a relationship established so that subsequent objective data can be converted into key preset instructions. Therefore, when new objective data (percentage coverage) information is obtained from the light table, that may be analyzed by breaking it down into its harmonic components, and by reference to the set of parameters m and b as represented by FIG. 9, the key set position is obtained by summing the predicted key position values obtained from each harmonic component.

Two computer programs are listed below. Program C1 analyzes the information recorded in the press from the prior ten jobs and uses that information to generate the parameters utilized by program C2 which provides instructions for presetting the keys of the fountain in response to the information obtained from optically scanning a printing plate.

These programs are written in Fortran as illustration of one to implement the procedures of this invention. This analysis may be made by an adapter circuit 100 shown in FIG. 6. All unexecutable statements, linkages, etc., which might obscure the source program understanding have been omitted. The following abbreviations will be used.

I=Fountains

J=Fourier components
K=Key numbers
L=Jobs
NK=Key values
NS=Normalized screen values The listed programs assume that all major information about key set points, KSETP (I,J), and the ink transfer functions ITRFN (I,J), for all twelve fountains (I=1, 2, . . . 12) and all nine Fourier components (J=1, 2, . . . 9), i.e., for the average, the "zero" harmonic and the sin and cos components of the first four harmonics) are saved in some common statement:

```
COMMON KSETP (12,9), ITRFN (13,9).
```

The retrieval of information for all ten jobs (L=1, 2, . . . 10) saved in memory for all 24 Key numbers (K=1, 2, . . . 24) for both the "normalized" screen values, NS(I,K), and the Keys, NK(I,K), can be made with a calling statement such as:

```
READ(L,*) NS(I,K), NK(I,K).
```

ADAPTIVE ALGORITHM C1, Analysis

```
DO 30, I=1,12
DO 30, J=1,9
X=XX=YY=Y=0
DO 20, L=1,10
SJ=KJ=0
DO 10, K=1,24
READ(L,*) NS(I,K), NK(I,K)
A=SIN(360/24*INT(J/2.0)*(K-1+45*
(1+(-1)**(J+L)))*(1+(J#1))
SJ=SJ+NS(I,K)/65535/24*A
KJ=KJ+(4095-NK(I,K))/81.92/24*A
CONTINUE
X=X+SJ
XX=XX+SJ*SJ
XY=XY+SJ*KJ
Y=Y+KJ
CONTINUE
ITRFN (I,J) = (XY-X*Y/10)/(XX-X*X/10)
KSETP(I,J) = Y/10-ITRFN(I,J)*X/10
CONTINUE
END
```

Control Program C2

```
DIMENSION S(9)
DO 30,I=1,12
DO 10, J=1,9
S(J)=0
DO 10,K=1,24
READ (L,*) NS(I,K)
S(J)=S(J)+NS(I,K)/65535/24*SIN(360/24*INT
(J/2.0)*(K-1)+45*(1+(-1)**(J+1)))*(1+(J#1))
CONTINUE
DO 30, K=1,24
KJ=0
DO 20, J=1,9
KJ=KJ+(KSETP(I,J)+ITRFN(I,J)*S(J))*SIN
(360/24*INT(J/2.0)*(K-1)+45*(1+(-1)**(J+1)))
CONTINUE
NK(I,K)=4095-KJ*81.92
CONTINUE
```

-continued

```
END
```

Figure 11:
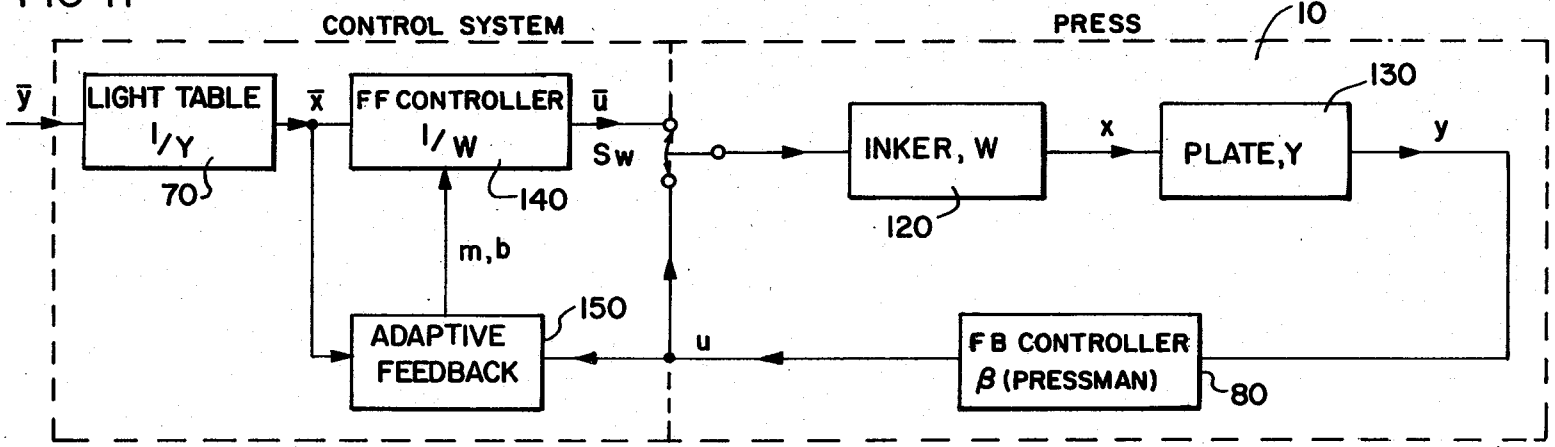
FIG. 11 is a block diagram of the basic components comprising the invention.

A block diagram of the components of the invention is presented in FIG. 11. It includes a controller and a press. The press can be fully described as including three variables:

the control variable u, the key settings;
the state variable x, the ink flow; and
the output variable y, the printed image.

An inker 120 with the transfer function W(x=W(u)) presents the supply parts, and a plate 130 with the transfer function Y(y=Y(x)) presents the demand part of the object.

The press 10 itself is a perfect closed-loop control system (switch SW is down) with a pressman 80 working as a feedback (FB) controller. By looking at the image y, he adjusts the ink keys $u=\beta(y)$ so as to provide the inker's supply consistent with the plate's demand.

As it often happens with open-loop systems, the controller is a "mirror image" (or better, a conformal depiction) of the press, with a "backward" flow of information. The light table 70 provides the plate's inverse transfer function $(1/Y)[\bar{x}=(1/Y)(\bar{y})]$; and the feedforward (FF—we also can call it "Fourier function") controller 140, with inker's inverse transfer function $(1/W)[\bar{u}=(1/W)(\bar{x})]$, is the inker's "backward" model.

It can be seen that the controller reduces the information from an image $\bar{y}$ to the ink coverage $\bar{x}$, to the key settings $\bar{u}$, while the press (Sw up) returns it back, from the key settings to the image.

The adaptive feedback system 150 updates the FF Controller's 140 parameters, the m's and b's for all 9 inker's harmonic components, according to the current changes W in the inker's characteristics, by correlating the pressmen's "OK" settings u to the corresponding ink coverages $\bar{x}$. If it were no inconsistent jobs in real production, it would be enough to use only the Adaptation algorithm C1 as the single Adaptive Feedback needed. But, it becomes only a part of the Adaptive feedback system if the inconsistencies described above are considered.

Figure 12:
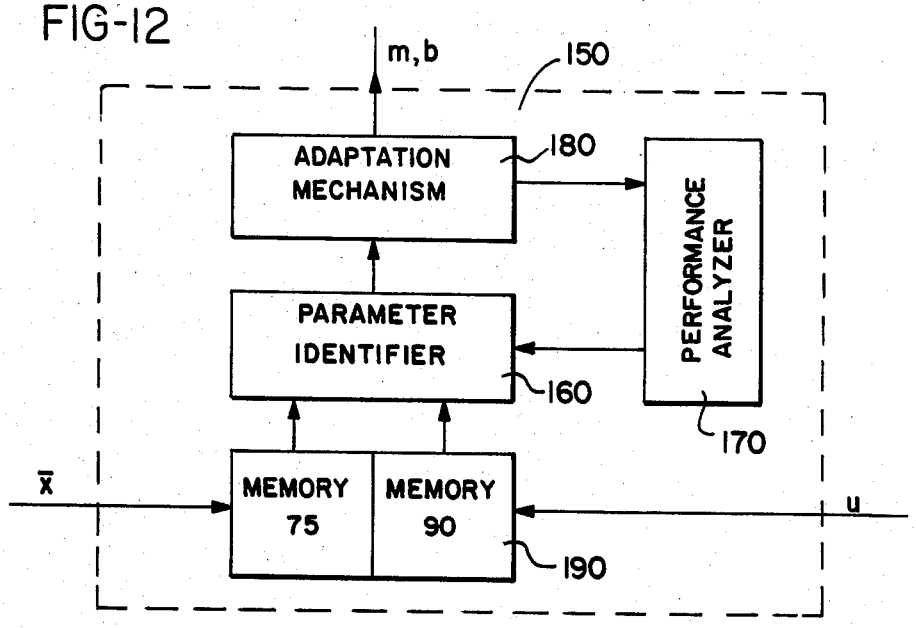
FIG. 12 is a block diagram showing an adaptive feedback system.

The major part of the Adaptive feedback system (FIG. 12) is in the decision-making Parameter Identifier block 160 which forms the "families" of jobs presenting the current status of inkers—both for continuous, and for alternative adaptation, for startup conditions, etc. The Performance Analyzer 170 calculates the adaptation errors for each adapted job and tests them according to the acceptance/rejection criteria, thus providing the Parameter Identifier with the basic information for making decisions on pooling.

It can be noticed that the Performance Analyzer 170 provides a feedback (from the output/parameters to the input/decisions) in the parameter identification system.

A listing of the actual Adaptive Feedback software (in the HPL language) is given below.

```
0: dim F,O$[8,48],K$[8,48],C$[8,36],I$[8,30],T$[14],J$[8]
1: dim G$[80],H$[8,150],P$[11,48],U$[11,48],A$[33],F$[36]
2: dim L$[99,30],S$[8,36],M$[8,30],Z[11],V[11],Y[3]
*32278
124: "ADAPT":
125: F→D;for I=1 to 8;C$[I]→S$[I];I$[I]→M$[I];next I
126: if F<4,c11 'OUTPUT'; ret
127: "START A":" "→A$;P+1→P;if P=9;D→F;c11 'OUTPUT';ret
128: 0→L;if D<12 or len(M$[P])=0;1→M;gto +4; if D>11;D-10→M;gto +4
129: M$[P]→A$;val(A$[len(A$)-2,len(A$)])→L;len(A$)/3→M;val(A$[1,3])→N
```

-continued

```
130: if D−N<11;N→M;gto +2;if D−N=M;gto +3
131: gto +2;if (D−L>M)(D−N>15);1→M;gto +1;if D−L>11;D−L−10→M;gto +1
132: " "→A$;for I=M to D−L−1;str(L+I)→A$[3(I−M+1)−2,3(I−M+1)];next I
133: str(D)→A$[len(A$)+1,len(A$)+3]
134: for I=1 to len(A$)/3;val(A$[3I−2,3I])→F
135: if F<26;1df F+5,O$,K$,C$,I$;gto +2
136: trk 1;1df F−25,O$,K$,C$,I$;trk 0
137: O$[P]→P$[I];K$[P]→U$[I]
138: if U$[I,1,2]=" ";A$[3I+1]→A$[3I−2];gto −4;if len(A$)/3<4;gto "START A"
139: next I;gsb "FOURIER"
140: if (not flg8)(len(A$)<33);A$→M$[P];F$→S$[P];gto "START A"
141: if (not flg8)(len(A$)=33);A$[4,33]→M$[P];F$→S$[P];gto "START A"
142: if len(A$)/3<4;cfg 8;gto "START A"
143: val(A$[len(A$)−2,len(A$)])→L;if (L#D)(D−L<4);cfg 8;gto "START A"
144: if (L#D)(D−L>3);" "→A$;for I=1 to D−L;str(L+I)→A$[3I−2,3I];next I
145: cfg 8;gto −11
146: "FOURIER":sfg 14;len(A$)/3→L;" "→F$
147: for J=1 to 9;0→X→Y→Y[1]→Y[2]
148: for W=1 to L;0→C→K
149: for I=1 to 24
150: itf(P$[W,2I−1,2I])→O;itf(U$[W,2I−1,2I])→U
151: if O<0;32767−O→O
152: O/65535→O;(4095−U)/81.92→U
153: sin(2π/24*int(J/2)(I−1)+π(1+(−1) ^ (J+1))/4)(1+(J#1))/24→A
154: C+OA→C;K+UA→K
155: next I;C→Z[W];K→V[W]
156: X+C→X;Y+K→Y
157: Y[1]+CC→Y[1];Y[2]+KC→Y[2];next W
158: (Y[2]−XY/L)/(Y[1]−XX/L)→Y[2];Y/L−Y[2]X/L→Y[1];1→M
159: for W=1 to L;abs(V[W]−Y[1]−Y[2]Z[W])→A;if A>M;sfg 8;A→M;W→N
160: next W;if flg8;A$[3N+1]→A$[3N−2];0→K→W;cfg 14;ret
161: fti (104.17Y[2]+9999)→F$[2J−1,2J]
162: fti (81.92Y[1]+9999)→F$[2J+17,2J+18]
163: next J;0→K→W;cfg 14;if itf(F$[1,2])<9999;sfg 8;" "→A$;ret
164: ret
*22898
```

The subroutine ADAPT comprises the Parameter Identifier 160, and the subroutine FOURIER comprises the Adaptation Mechanism 180, (it can be seen that this part of the subroutine is simply the Adaptation Algorithm C1, listed above) and (lines 159, 160) the Performance Analyzer 170.

The package has been developed for saving 99 jobs into memory 190 (comprising memories 75 and 90) with a job file F (line 0) comprising the following information for the 4-unit (8 fountains) press:

- the 0-("original," light table data) or x variable string, 0$[8,48] for 8 fountains and 24 key bands (2 bytes/-key), is stored in memory 75;
- the K-("key," the pressman's OK settings) or u variable string, K$[8,48] for corresponding fountains and key bands, is stored in memory 90;
- the C-("coefficients," the m's and b's) string, C$[8,36] for the 9 harmonic components (2×2 bytes/component) per fountain;
- the I-("identification") string, I$[8,30] for listing up to 10 previously adapted jobs (3 bytes/job#) per fountain.

The P$, U$, S$, M$ strings (lines 1,2) are doublers of the 0$, K$, C$, I$, respectively, for forming the adaptation stacks of jobs; and the A$, F$ are the operand strings doubling I$, C$, but only for one, currently in adaptation, fountain.

The Parameter Identifier 160 (FIG. 12), subroutine ADAPT (line 124):

- (line 125) begins with unloading the coefficients and identification lists for all 8 fountains (I=1 to 8) of the current job;
- (line 126) checks the lower limit of jobs available for adaptation (Section III, paragraphs/cases 10*b*, 3*a*); if less than 4 jobs available, assumes the default condition (case 4*d*);
- (line 127) establishes the fountain/plate loop (from P=1 to 8)
- (line 128) checks and executes, if appropriate, the startup condition (case 3*a*);
- (lines 129, 130) checks and executes, if conditions are met, the continuous adaptation (case 3*b*);
- (lines 131, 132) if appropriate, forgets the old adaptation (case 3*c*);
- (line 133) executes the "terminal" adaptation (case 3*d*).

Thus, forming a pool of jobs for adaptation results in forming a list of jobs in the A$ string and stored in memory 190. Then (lines 134–139), under control of this string, a stack of jobs is formed for a particular fountain, P$-U$, and it is transferred (gsb FOURIER, line 139) to the Adaptation Mechanism for finding the new adaptive coefficients.

Figure 4:
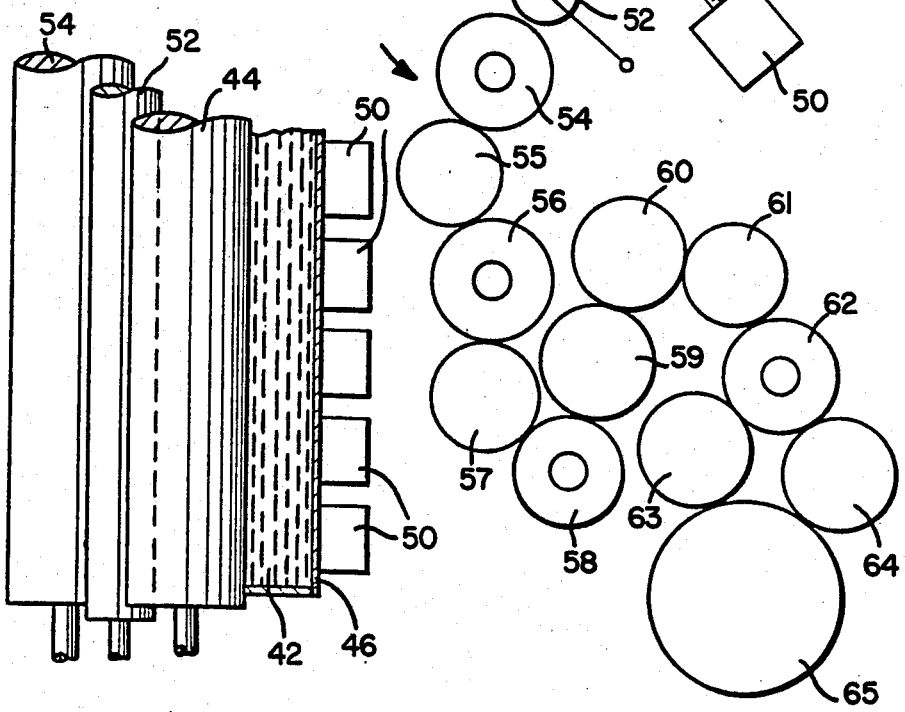
FIG. 4 is a view taken along line 4—4 of FIG. 3 showing a detail of a portion of the ink distribution system.

The Adaptation Mechanism 180 (FIG. 12), subroutine FOURIER (line 146, FIG. 4) finds the adaptive coefficients (lines 147–158) according to the C1 algorithm, and if their accuracy is acceptable, saves them in the F$ string (lines 161–146). Otherwise, the Performance Analyzer 170 (lines 159, 160) terminates the cycle of adaptation.

The Performance Analyzer 170, subroutine FOURIER (line 159) checks the adaptation errors A with respect to the found regression line, for all L jobs. If, for any of the jobs, the error A exceeds the threshold M (the initial value M=1.0 mil, line 158), the analyzer sets flag #8 (sfg 8) memorizes the job # (W N) with the unacceptable error, and continues the loop in order to find a job with the largest error. Then, the analyzer eliminates the job from the list in the A$ string and returns to the Parameter Identifier 160.

The Parameter Identifier 160, after getting feedback from the Performance Analyzer 170 that adaptation is acceptable (not flg 8, lines 140, 141), starts the new cycle of adaptation for the next plate/fountain) gto "START A"), with (line 141) or without (line 140) eliminating the first adapted job for the "running pool" condition.

Otherwise, if in the previous adaptation cycle an unacceptable job has been eliminated, the identifier (lines 142, 143) goes to adapt the next plate because of default condition: less than 4 jobs has been left either for the direct (line 142), or the alternative (line 143) adaptation;

(line 144) tries the alternative adaptation (case 2), and/or (line 145) starts a new cycle of adaptation with the newly formed pool of jobs.

While the method herein described constitutes a preferred embodiment of the invention, it is to be understood that the invention is not limited to this precise method and that changes may be made therein without departing from the scope of the invention which is defined in the appended claims.

What is claimed is:

1. Process for presetting the fountains of a printing press based on objective data obtained from optically scanning the material to be printed, comprising the steps of:

a. optically scanning the material to be printed along those areas corresponding to the keys of an ink fountain to obtain objective data regarding the average density of ink coverage in those areas;

b. storing said objective data derived from a predetermined number of the most recent jobs run on a particular printing press;

c. sensing the position of each key of an ink fountain after the keys have been set to the operator's satisfaction as subjective data representing a particular job;

d. storing said subjective data for a corresponding number of the most recent jobs;

e. correlating the objective and the subjective data for each of the jobs accumulated;

f. calculating a regression line representing the best fit among all of the stored jobs;

g. comparing each job to the calculated regression line, and rejecting that job which has the greatest deviation from said regression line in excess of a predetermined acceptable limit;

h. recalculating a new regression line to obtain the best fit among the remaining jobs;

i. comparing each remaining job to the recalculated regression line and rejecting that job which has the greatest deviation in excess of a predetermined acceptable limit;

j. repeating steps h and i until all jobs remaining fit the recalculated regression line within the acceptable limits; and k. using the redefined regression line to calculate the anticipated key settings for the next job to be run on the press based on the objective data obtained from optically scanning the material to be printed; and l. presetting the keys of the fountain in accordance with the calculated key settings.

2. The process of claim 1 wherein the objective and the subjective data are analyzed for the average and for the sine and cosine functions of the first four harmonics for each of the objective and subjective data.

3. The process of claim 1 wherein a minimum of four jobs must remain in the pool to provide a valid regression line calculation.

4. The process of claim 1 wherein each job rejected in calculating the regression line is tested and identified and wherein if the last four most recent jobs are all rejected, then these jobs will be used to calculate a new regression line.

* * * * *